US006798392B2

(12) United States Patent
Hartwell et al.

(10) Patent No.: US 6,798,392 B2
(45) Date of Patent: Sep. 28, 2004

(54) SMART HELMET

(75) Inventors: Peter G. Hartwell, Sunnyvale, CA (US); James A. Brug, Menlo Park, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 250 days.

(21) Appl. No.: 09/977,689

(22) Filed: Oct. 16, 2001

(65) Prior Publication Data

US 2003/0071766 A1 Apr. 17, 2003

(51) Int. Cl.[7] ..... G09G 5/00
(52) U.S. Cl. ..... 345/8; 345/7; 345/158
(58) Field of Search ..... 345/8, 7, 87, 158; 340/426.19, 426.22

(56) References Cited

U.S. PATENT DOCUMENTS 4,032,127 A * 6/1977 Lipfert ..... 267/151
4,792,697 A * 12/1988 Le Parquier et al. .... 250/559.3
5,815,126 A * 9/1998 Fan et al. ..... 345/8
5,886,667 A * 3/1999 Bondyopadhayay . 343/700 MS
5,940,172 A * 8/1999 Ball ..... 356/146
5,991,085 A * 11/1999 Rallison et al. ..... 359/630
6,157,298 A * 12/2000 Garfinkel et al. ..... 340/479
6,172,657 B1 * 1/2001 Kamakura et al. ..... 345/8
6,297,767 B1 * 10/2001 Senoh ..... 342/357.08
6,483,646 B2 * 11/2002 Scott et al. ..... 359/631
6,556,183 B1 * 4/2003 Gartrell et al. ..... 345/156

* cited by examiner

*Primary Examiner*—Chanh Nguyen
*Assistant Examiner*—Fritz Alphonse

(57) ABSTRACT

A smart helmet included integrated electronics providing safety and convenience features. Helmet features includes a global locating system, an environmental interaction sensor, a mobile communications network device, a small display panel, a microphone and at least one speaker. The helmet is aware of the user's location and interactions with the environment. The helmet can provide data to a user, monitor the user's actions and condition, and send information to others about user's location and condition.

25 Claims, 3 Drawing Sheets

SMART HELMET

FIELD OF THE INVENTION

This invention relates generally to helmet technology and more particularly to a smart helmet that has integrated electronics which actively monitors a user's environment and provides various kinds of information to the user.

BACKGROUND OF THE INVENTION

Helmets and other protective headgear have evolved over the years. It is not uncommon for individuals to wear protective headgear when they are, for example, riding bicycles, riding horses, roller-blading, playing football, playing baseball, playing hockey, skiing and skating, as well as for other general safety purposes.

Helmets have the primary function of protecting the head of a person from an injury that may be sustained while engaged in work, sports and other activities. Moreover, as outdoor activities, have increased in popularity, the need emerged for even more specialized helmets. For example, as cycling and motorcycling have grown in popularity, so has the injuries resulting from accidents involving cycling or motorcycling. It is estimated that more than 20,000 people per year are admitted to hospital because of bicycle and motorcycle related injuries.

As a result, many states and jurisdictions require the use of safety helmets when operating a bicycle or motorcycle. 20 states including the District of Columbia and 85 localities have laws requiring the use of safety helmets when operating a bicycle or motorcycle. There have been several attempts to institute federal regulations requiring helmets.

Helmets manufactures have increased safety features using various types of foams and hard plastic materials to reduce head trauma that occurs during accidents. The helmet requires a layer of stiff foam to cushion the blow by crushing. Nearly all bicycle helmets do this with expanded polystyrene (EPS), the white picnic cooler foam used to protect eggs and computers. Once crushed, the foam does not recover. Spongy foam is added inside for comfort and fit. Another foam, expanded polypropylene (EPP), does recover, but its use is spreading slowly. It may have some undesirable "rebound." A stronger EPS called GECET appeared in 1992 and is widely used now. A third foam called EPU (expanded polyurethane) is used for helmets made in Taiwan. It has a uniform cell structure and good crush without rebound, but is difficult to manufacture and not used much in the U.S.

Also, the helmet manufactures realize protective helmets can incorporate other safety features such as two-way and AM/FM radios, turn signals, rearview mirrors and other safety devices. Protective helmets with two-way communication systems are generally well known. Some of these well-known systems carry a transmitting unit within the helmet, but have the disadvantage of using an umbilical cord to a base unit. Such a unit is not a complete and self-contained system. Other known units have an external antenna, are not protected from shock, and provide earphones which may completely cover the ear. Still other known units do not provide a proper cushioning for the electronics itself. Consequently, the electronics may be damaged from impact to the helmet.

Helmets having integrated electronics have been utilized for some time in work place and recreational settings. One such device has been invented by Kawaguchi et al. as disclosed in U.S. Pat. No. 4,648,131. This helmet is for intercommunications between workers as well as between a central control room and other workers.

The invention disclosed in U.S. Pat. No. 4,833,726 to Shinoda et al. teaches a helmet with two-way radio communication facilities to be used by workers in the construction industry.

The invention disclosed in U.S. Pat. No. 5,353,008 to Eikenberry et al. teaches a motorcycle helmet with brake lights including a duty cycled receiver circuit for receiving a radio frequency signal from a transmitter located on the motorcycle.

U.S. Pat. No. 3,586,977 to Lustig et al. discloses voice communications between a motorcycle rider and passenger when both are wearing motorcycle helmets.

However, the helmets described in the prior art are passive and fail to be responsive to the user's environment.

By integrating safety monitoring features, a helmet provides extra level of security in case of emergency. By integrating navigation and communications into the helmet, the amount of extra equipment (e.g., cell phones, organizers, etc.) a user required to carry is lessened while accessibility to the equipment is increased.

SUMMARY OF THE INVENTION

In one respect, the invention is a smart helmet comprising an outer shell affixed to the inner shell, an inner shell adapted to fit onto the head of a user, an module affixed into the inner shell, such that, the module monitors the user's location and interactions with the surrounding environment. The module can be programmed to automatically call predetermined phone numbers in emergency situations and programmed to provide real-time location information to the user during operation.

The inner shell of the helmet is preferably made from a shock-absorbent material. The outer shell is preferably constructed from a sturdy, durable plastic material. An module is mounted inside the inner shell of the helmet. The module passively monitors the user's environment.

The module further includes an environmental interaction sensor, global locating system, a mobile communications network, a small display panel, a microphone and speakers. The environmental interaction sensor is preferably an accelerometer or gyroscope. The global locating system is a global positioning system (GPS). The mobile communications is a cellular phone, and the small display panel is a LCD dot-matrix screen which allows the user to interact with the device using a touch screen.

In another respect, the invention is an apparatus comprising a helmet and an integrated circuit affixed to the helmet. The integrated circuit comprises a processor circuit for controlling the operations of the integrated circuit, at least one environmental sensor, a display, a global locating system, a mobile communications device, a microphone, and at least one speaker. The integrated circuit actively monitors predetermined characteristics of a user of the helmet.

The helmet includes an inner shell adapted to fit onto the head of a user such that the inner shell is made from a shock-absorbent material. The helmet includes an outer shell affixed to the inner shell and the outer shell is made from a sturdy, durable material. The module is affixed to the inner shell of the helmet. The environmental interaction sensor is a accelerometer or gyroscope. The global locating system is a global positioning system (GPS). The mobile communications device is a mobile telephone device. The display is a LCD dot-matrix display.

The module includes a LCD panel display, such that the user input information using a touch screen built into the display. The step of programming the module to provide the user with real time navigation and route information and allowing for "hands free" communication.

In comparison to known prior art, certain embodiments of the invention are capable of achieving certain advantages, including some or all of the following: (1) providing an extra level of security in emergency situations; (2) reducing the amount of the extra equipment (e.g., cell phones, organizers, etc) carried during the activity and reducing distraction for the user during the performance of the activity; and (3) providing added convenience of having a wide variety of electronic devices available. Those skilled in the art will appreciate these and other advantages and benefits of various embodiments of the invention upon reading the following detailed description of a preferred embodiment with reference to the below-listed drawings.

BRIEF DESCRIPTION OF THE DRAWINGS

A more complete understanding of the invention and its advantages will be apparent from the following detailed description taken in conjunction with the accompanying drawing, wherein examples of the invention are shown and wherein.

DETAILED DESCRIPTION OF A PREFERRED EMBODIMENT

In the following detailed description, numerous specific details are set forth in order to provide a thorough understanding of the present invention. However, it will be apparent to one of ordinary skill in the art that these specific details need not be used to practice the present invention. In other instances, well known structures, interfaces, and processes have not been shown in detail in order not to unnecessarily obscure the present invention.

Figure 1:
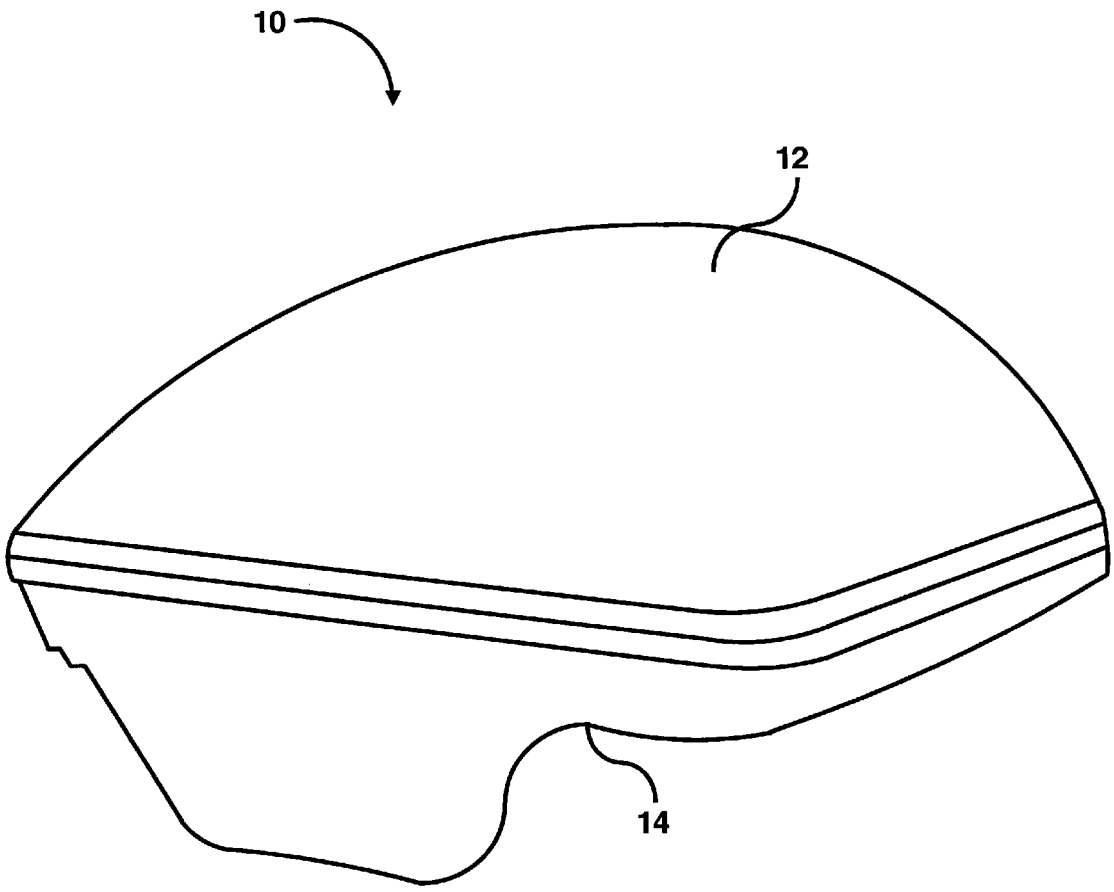
FIG. 1 illustrates side view of the helmet according to an exemplary embodiment of the invention.

Referring now to the drawings, and in particular to FIG. 1, the present invention is shown generally at numeral 10. The present invention includes a helmet having of an outer shell 12 and an inner shell 14. The inner shell 14 can be made a foam core of cushioning material which has shock absorbing characteristics. The inner shell 14 is designed to fit comfortably upon a user's head. The outer shell may be made of a hard insulating plastic material or a similar durable material and is adapted to fit over the inner shell 14. The outer shell 12 is affixed to the inner shell 14 via affixing material such as VELCRO™, snaps and glue which are placed about the periphery of each shell (not shown). Affixed to the inner shell 14 includes chin straps (not shown) which includes both a side component and a rear component, both of which extend from the inner shell 14 to secure the helmet 10 to the user's head.

Figure 2:
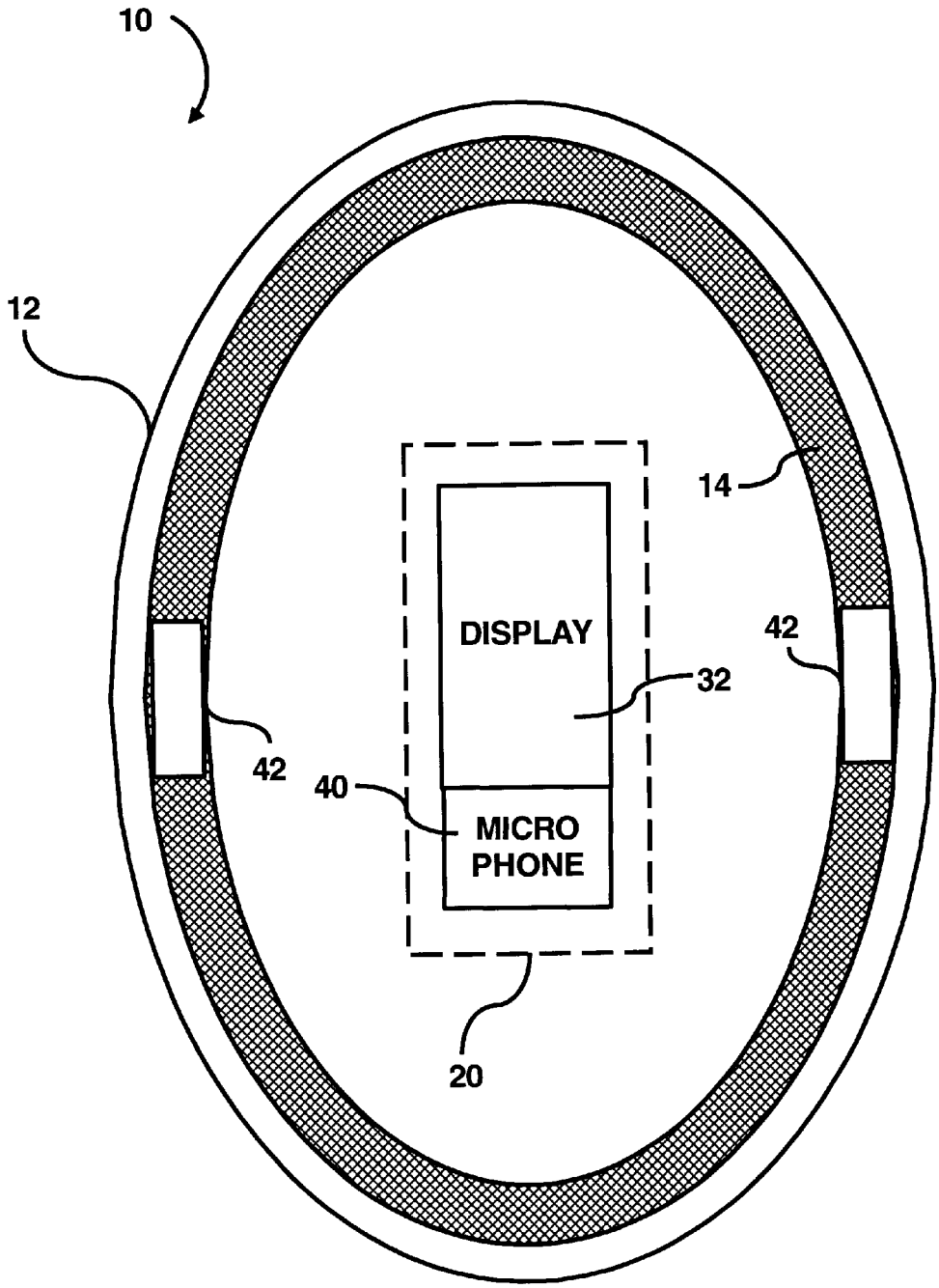
FIG. 2 illustrates the interior of the helmet according to an exemplary embodiment of the invention.

FIG. 2 shows a view of the interior of the helmet 10 and shows the module 20 mounted inside the inner shell 14 of the helmet 10, such that the display 32 and microphone 40 are exposed to the user. The module 20 is an integrated circuit (IC). Also, embedded in the inner shell 14 and effectively floating therein is a pair of miniature speakers 42 which are placed so as to be adjacent to the ears of the wearer of the helmet 10. One of ordinary skill can appreciate that the module 20 can be mounted anywhere in the helmet and the particular location illustrated in FIG. 2 is for illustrative purposes only.

A portion of the inner shell 14 of the helmet 10, the module 20 may be embedded. The module 20 can be fastened to the inner shell 14 according to conventional methods, such as a high strength glue or plastic material. The preferred embodiment of the invention calls for the module 20 to be situated in the crown of the helmet so as to reduce the chances for interference with the comfort of the rider and accidental activation. However, one of ordinary skill in the art can envision various locations in which the circuit can be implanted, (e.g. the inner shell or the outer shell).

Figure 3:
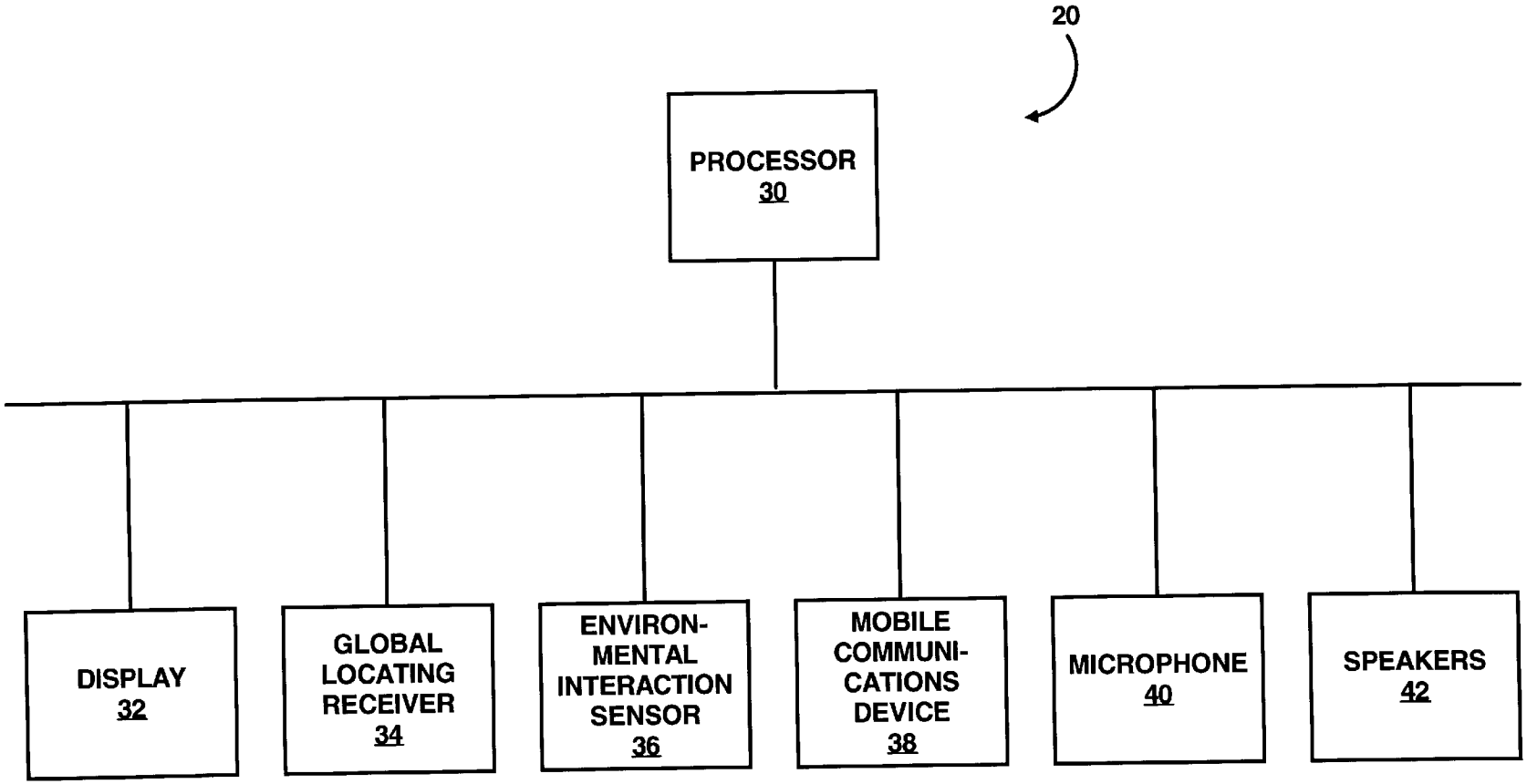
FIG. 3 is block diagram of the module according to an exemplary embodiment of the invention.

FIG. 3 shows the block diagram of the preferred embodiment of the module 20. The module 20 comprises a processor 30, a small panel display 32, a global locating receiver 34, an environmental interaction sensor 36, a mobile communications device 38, a microphone 40, and speakers 42. Each of the elements is connected via a bus which is connected to the processor 30. The devices can be miniature in size, so that the device 20 is small enough to fit in the inner shell 14 of the helmet.

The helmet module 20 actively monitors predetermined characteristics of the user and communicates those characteristics to the user and others. The predetermined characteristics are, but not limited to, the ability to determine and monitor the user's location, the user's instantaneous speed and distance traveled, and the ability to communicate with others using a mobile communication device 38. One of ordinary skill in the art can appreciate that other characteristics may be employed.

The processor 30 controls the operation of the module 20. The processor 30 receives and transmits signals to the other devices in the module 20. The processor 20 also contains at least one memory device (not shown) which stores information retrieved by the various devices. Also, the processor 20 stores software which is used in connection to with the devices. The processor 20 may also be connected to a power supply (not shown).

The panel display 32 allows the user to interact with the module 20. The preferred panel display 32 can be LCD dot-matrix screen however, one of ordinary skill can envisage other types of display technology being used. The panel display 32 may include a touch pad or a touch screen to prevent accidental activation while the helmet is on the head of the user. The panel display 32 allows the user to select the information to be displayed, collected and stored. A touch pad or screen can be employed to configure and interact with numerous features of the module.

The global locating receiver 34 provides real-time location information to the user or an authorized person. The global locating receiver 34 can employ known global positioning system technology such as GPS and LORAN. However, one of ordinary skill in the art can envision using other types of locating technology. Also, the helmet 10 can send information to others regarding the user's location and condition. The global locating receiver 34 can be accessed by a third party, for example, to allow a parent to monitor the location of a child wearing the helmet.

The environmental interaction sensor 36 can be an accelerometer, gyroscope or other device which measures a physical quantity. The environmental interaction sensor 36 monitors the user's surrounding environment and provides information such as speed and distance traveled. One of ordinary skill can envision other types of information being measured by the sensor, and speed and distance are discussed for illustrative purposes. The environmental interaction sensor 36 contains a conventional microprocessor circuit incorporating software which performs the desired functions.

Also, included in the module 20 is a mobile communications device 38. The mobile communications device 38 can be a conventional two-way communications device or cellular communications device. The mobile communications device 38 is operates in conjunction with the panel display 22 and the microphone 40 and speaker 42. The user operates the mobile communications device 38 in a manner similar to a ordinary mobile phone. The user would use the touch-screen, voice activation or a keypad as an input device and the device 38 can employ all the features of a known mobile phone.

The microphone 40 is similar to the conventional microphones used in mobile telephony devices. The microphone 40 is located on the face of the module 20, in relative close proximity to the display 32. For safety reasons, the user will have to remove the helmet 10 in order to speak into the microphone 40. This feature prevents the user from being distracted while engaging in a activity. However, one of ordinary skill can envision a microphone which is attached to the helmet in such a way as to allow a user to speak into the microphone which the helmet is fastened to the user's head.

The speakers 42 are similar to the conventional speakers used in mobile telephone devices. The speakers 42 operate in conjunction with the mobile communications device 38. Also, the speakers 42 can be used to broadcast predefined messages stored in the processor 30 to the user. The speakers 42 are connected by wires (not shown) embedded in the inner shell 14. The speakers 42 are near the user's ear to prevent the user from becoming distracted and to protect them while they are involved in a specific activity.

In the preferred embodiment of the invention, the helmet 10 is aware of the user's surrounding environment. For example, the helmet 10 senses the users location and interactions with the environment. The helmet 10 can provide information to user, such as the user's location, speed, and direction. The helmet 10 can also monitor the user's actions and physical condition. These functions are performed by sensors (not shown) stored in the module 20. However, one of ordinary skill in the art can envision a helmet with sensor placed on or about the interior or exterior of the helmet gathering information. The sensors are of the type well known in the art. The preferred embodiment of invention includes an environmental interaction sensor 36 such as an accelerometer or gyroscope. One of ordinary skill in the art can envision various other known types of sensors which measure different types of forces.

While the above description refers to the preferred embodiment of the invention, one of ordinary skill in the art can easily recognize that the helmet style can be adapted for use in a specific activity. Custom helmets could be made for at least bicycles, motorcycles, small-wheeled devices (such as skateboarding, scooters, etc) and skiing.

Also, one of ordinary skill in the art can appreciate the fact that the functions of the helmet 10 can be adapted to fit a specific activity. The helmet 10 can be configured to provide a low cost emergency response, if for example, the user crashes while performing an activity. The environmental interaction sensor 36 in the module measures the force of the impact and communicates this measurement to the processor 30. If the processor 30 determines that the force is greater than a predetermined threshold, then processor transmits a signal to for mobile communications unit 38 to broadcast a stored message via the loud speakers 42 ("Are you okay?"). If the user responds, either by voice or input via the display panel 32 with in a predetermined time, then the processor returns the helmet 10 to normal operation. However, if there is no response with in a predetermined time, the mobile communications device 38 in the module calls a predetermined number (for example, 911 or the number of an employer) for responsible individuals or emergency personnel. Once the contact is made, the global locating system 34 in the module 20 transmits the location of the helmet 10 (and as such the user) to the appropriate authorities.

Or the helmet 10 can also be configured as a touring helmet. The touring helmet contains all the emergency response features described above and features for navigation and communications. Routes can be preprogrammed or downloaded into the processor 30 before the journey. The global locating system 34 in the module can track the user as the journey progresses and prompt the user about up coming turns, sights and traffic conditions. Navigation is possible without having to look at a map while operating a vehicle (such as a motorcycle). It is possible that the user can use the mobile communications device 38 to receive or initiate a telephone calls in a "hands free" mode. Or use the mobile communications device 38 as a two-way communicator to talk to others in the riding group.

These two examples are illustrative in nature of the different capabilities of the invention. One of ordinary skill in the art can appreciate that there are numerous more applications to the invention.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An apparatus comprising:

a helmet including a module which actively monitors predetermined characteristics of the user and communicates those characteristics with the user and others, wherein the module actively monitors the user's location and interactions with the surrounding environment;

wherein the helmet includes an inner shell adapted to fit onto the head of a user such that the inner shell is made from a shock-absorbent material;

wherein the module is affixed to the inner shell of the helmet.

2. The apparatus of claim 1, wherein the helmet includes an outer shell affixed to the inner shell and the outer shell is made from a sturdy, durable material.

3. The apparatus of claim 1, wherein the module is programmable to automatically call predetermined phone numbers in emergency situations and programmed to provide real-time location information.

4. The apparatus of claim 3, wherein the module further comprises at least one environmental interaction sensor, global locating system, a mobile communications network, a display, a microphone and at least one speaker.

5. The apparatus of claim 4, wherein the environmental interaction sensor is a accelerometer or gyroscope.

6. The apparatus of claim 4, wherein the global locating system is a global positioning system (GPS).

7. The apparatus of claim 4, wherein the mobile communications device is a mobile telephone device.

8. The apparatus of claim 4, wherein the display is a LCD dot-matrix display.

9. An apparatus of claim 1, further comprising a processor which controls the operations of module.

10. The apparatus of claim 1, wherein the module is located in approximately a crown of the helmet.

11. An apparatus comprising:

a helmet, wherein the helmet includes an inner shell adapted to fit onto the head of a user and an outer shell affixed to the inner shell;

an integrated circuit affixed to the inner shell of the helmet, comprising:

a processor circuit for controlling the operations of the integrated circuit; at least one environmental sensor;

a display;

a global locating system;

a mobile communications device;

a microphone; and at least one speaker;

such that the integrated circuit actively monitors predetermined characteristics of a user of the helmet.

12. The apparatus of claim 11 wherein the inner shell is made from a shock-absorbent material.

13. The apparatus of claim 11, wherein the outer shell is made from a sturdy, durable material.

14. The apparatus of claim 11, wherein the environmental interaction sensor is a accelerometer or gyroscope.

15. The apparatus of claim 11, wherein the global locating system is a global positioning system (GPS).

16. The apparatus of claim 11, wherein the mobile communications device is a mobile telephone device.

17. The apparatus of claim 11, wherein the display is a LCD dot-matrix display.

18. The apparatus of claim 11, wherein the integrated circuit is located in approximately a crown of the helmet.

19. A smart helmet comprising:

an inner shell means, adapted to fit onto a head of a user, for protecting the head of the user;

an outer shell means, affixed to the inner shell means, for protecting the inner shell means;

a module means affixed to the inner shell means, the module means comprising:

sensor means for sensing one or more of characteristics of the user and characteristics of the user's environment;

a global locating system means for determining a location of the user; and a display means for displaying at least one of information from the environmental sensor means and information from the global locating system means.

20. The smart helmet of claim 19, wherein the module means further comprises communication means for providing communication with other communication means.

21. The smart helmet of claim 20, further comprising automatic communicator means connected to the communication means, the automatic communicator means for invoking the communication means to communicate with the other communication means in response to the sensor means detecting at least one predetermined condition.

22. The smart helmet of claim 21, wherein the sensor means comprise means for detecting an impact.

23. The smart helmet of claim 19, wherein the module means is affixed approximately at a crown of the smart helmet.

24. The smart helmet of claim 19, wherein the display means comprises user input means for receiving user input to control the display of information on the display means.

25. The smart helmet of claim 24, wherein the user input means is operable to receive user input for controlling the communication means.

* * * * *